US005602560A

United States Patent [19]

Ikeda

[11] Patent Number: 5,602,560

[45] Date of Patent: Feb. 11, 1997

[54] APPARATUS FOR DRIVING LIQUID CRYSTAL DISPLAY PANEL WITH SMALL DEVIATION OF FEEDTHROUGH VOLTAGE

[75] Inventor: Naoyasu Ikeda, Tokyo, Japan

[73] Assignee: NEC Corporation, Tokyo, Japan

[21] Appl. No.: 413,765

[22] Filed: Mar. 30, 1995

[30] Foreign Application Priority Data

Mar. 30, 1994 [JP] Japan ..... 6-060442

[51] Int. Cl.[6] ..... G09G 3/36

[52] U.S. Cl. ..... 345/94; 345/58; 345/87

[58] Field of Search ..... 348/796; 345/94, 345/95, 58, 208, 210, 98, 87

[56] References Cited

U.S. PATENT DOCUMENTS 5,051,739 9/1991 Hayashida et al. ..... 340/784
5,248,963 9/1993 Yasui et al. ..... 345/98
5,457,474 10/1995 Ikeda ..... 345/92

FOREIGN PATENT DOCUMENTS 61-236593 10/1986 Japan .
62-271574 11/1987 Japan .
2-708 1/1990 Japan .

*Primary Examiner*—Victor R. Kostak
*Assistant Examiner*—Nathan J. Flynn
*Attorney, Agent, or Firm*—Foley & Lardner

[57] ABSTRACT

In an apparatus for driving a liquid crystal display panel having a plurality of gate bus lines, a plurality of data bus lines, and a plurality of pixels therebetween, a gate bus line driving circuit is connected to first ends of the gate bus lines, and an OFF level voltage applying circuit is connected to second ends of the gate bus lines opposite to the first end. The gate bus lines driving circuit selects one of the gate bus lines and applies a gate pulse thereto. The OFF level voltage applying circuit applies an OFF level voltage to the selected gate bus line by the gate bus line driving circuit immediately after the gate pulse is turned OFF.

9 Claims, 9 Drawing Sheets

S T

SCK

GP1

GP2

GP3

GP4

GP1024

SEL 1

SEL2

APPARATUS FOR DRIVING LIQUID CRYSTAL DISPLAY PANEL WITH SMALL DEVIATION OF FEEDTHROUGH VOLTAGE

BACKGROUND OF THE INVENTION

1. Field of the Invention

The present invention relates to a liquid crystal display (LCD) system, and more particularly, to an apparatus for driving an active matrix type LCD panel with a small deviation of feedthrough voltage.

2. Description of the Related Art

Since LCD panels are thinner in size and lower in power consumption with a lower power supply voltage as compared with CRT panels, the LCD panels have recently been applied to personal computers, word processors, color television receivers, and the like.

An active matrix type LCD panel includes a plurality of gate bus lines, a plurality of data bus lines, and a plurality of pixels arranged between the gate bus lines and the data bus lines. Also, each pixel is formed by a liquid crystal cell and a switching transistor which is, in this case, a thin film transistor (TFT). The TFT is connected between the liquid crystal cell and one of the data bus lines, and the gate of the TFT is connected to one of the gate bus lines.

A prior art apparatus for driving the above-described LCD panel, particularly, the gate bus lines, includes a gate bus line driving circuit formed by serially-connected shift registers whose outputs are connected to the gate bus lines. That is, a start pulse, which is in synchronization with a horizontal synchronization signal, is written into the first stage of the shift registers, and the start pulse is shifted through the shift registers. Thus, the shifted start pulse is sequentially applied as a gate pulse to the gate bus lines, and as a result, the gate bus lines are sequentially driven. This will be explained later in detail.

In the above-described driving apparatus, however, a feedthrough voltage of a pixel located near the gate bus line driving circuit is larger than a feedthrough voltage of a pixel located apart from the gate bus line driving circuit. This difference in feedthrough voltage may reduce the duration of the life of the LCD panel by the application of a DC voltage thereto.

In order to reduce the difference in feedthrough voltage, in another prior art apparatus for driving gate bus lines, gate bus line driving circuits are provided on both sides of the gate bus lines (see: JP-A-SHO57-100467). This will also be explained later in detail. In this prior art apparatus, however, the hardware is increased in size.

SUMMARY OF THE INVENTION

It is an object of the present invention to reduce the deviation of feedthrough voltage in an active matrix type LCD panel without increasing the size thereof.

According to the present invention, in an apparatus for driving an LCD panel having a plurality of gate bus lines, a plurality of gate bus lines, a plurality of data bus lines, and a plurality of pixels therebetween, a gate bus line driving circuit is connected to first ends of the gate bus lines, and an OFF level voltage applying circuit is connected to second ends of the gate bus lines opposite to the first ends. The gate bus line driving circuit selects one of the gate bus lines and applies a gate pulse thereto. The OFF level voltage applying circuit applies an OFF level voltage to the selected gate bus line by the gate bus line driving circuit immediately after the gate pulse is turned OFF.

Thus, transistors such as TFTs of the pixels connected to the gate bus line selected by the gate bus line driving circuit are turned OFF immediately after this gate bus line enters a non-selected state.

BRIEF DESCRIPTION OF THE DRAWINGS

The present invention will be more clearly understood from the description as set forth below, in comparison with the prior art, with reference to the accompanying drawings, wherein.

DESCRIPRION OF THE PREFERRED EMBODIEMNTS

Before the description of the preferred embodiment, prior art apparatuses for driving an LCD panel will be explained with reference to FIGS. 1, 2, 3A through 3E, 4 and 5.

Figure 1:
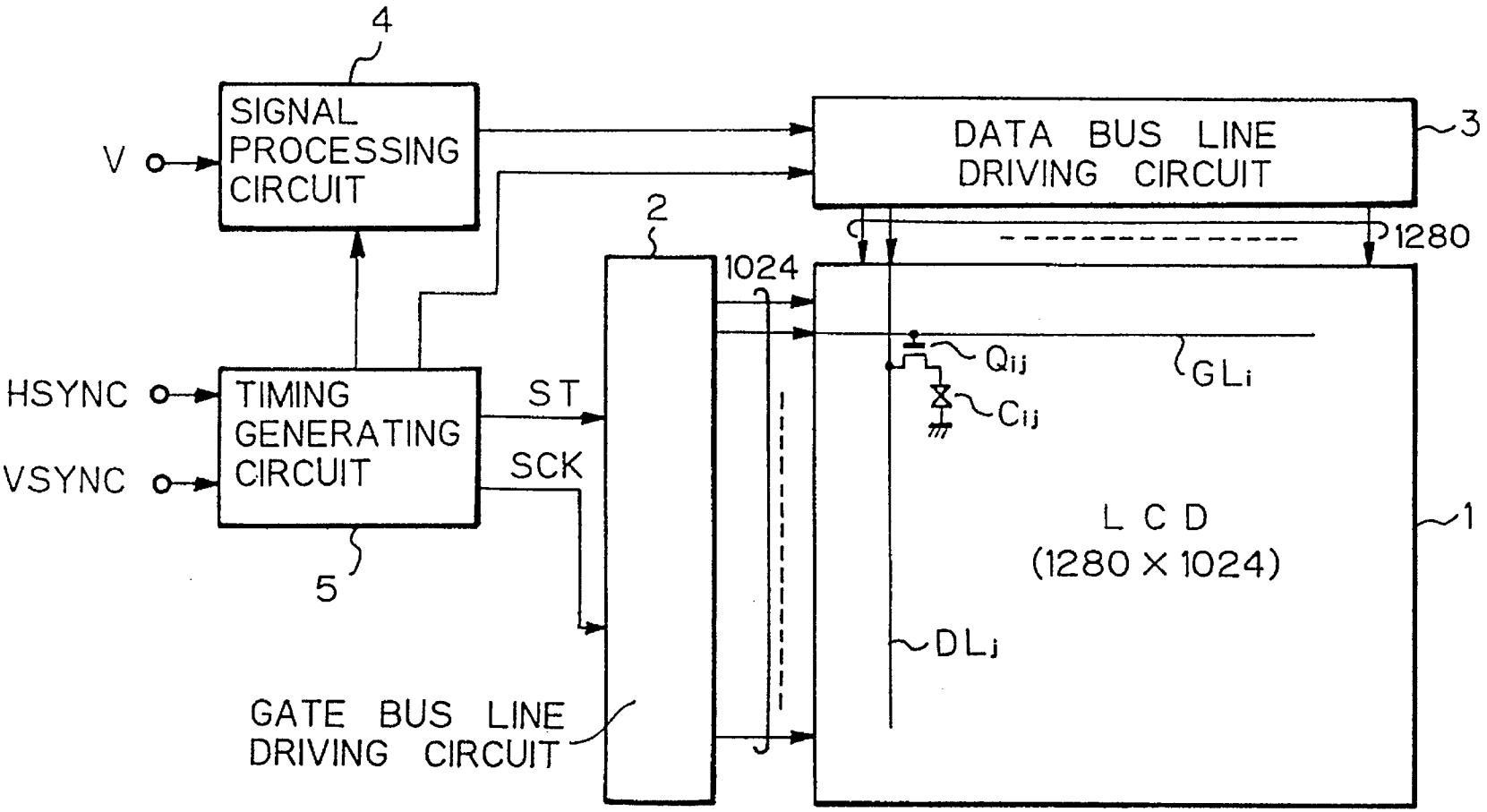
Fig. 1 PRIOR ART
FIG. 1 is a block circuit diagram illustrating a prior art apparatus for driving an LCD panel.

In FIG. 1, which illustrates a prior art apparatus for driving an LCD panel, reference numeral 1 designates an LCD panel having M×N dots where M=1280 and N=1024. That is, the LCD panel 1 has 1024 gate bus lines $GL_i$ (i=1, 2, . . . , 1024) driven by a gate bus line driving circuit 2, data bus lines $DL_j$ (j=1, 2, . . . , 1280) driven by a data bus line driving circuit 3, and pixels each connected to one of the gate bus lines and one of the data bus lines. Also, each of the pixels is formed by a thin film transistor (TFT) $Q_{ij}$ and a liquid crystal cell $C_{ij}$.

A signal processing circuit 4 receives a video signal V to thereby convert it by using a timing signal from a timing generating circuit 5. The output signal of the signal processing circuit 4 is supplied to the data bus line driving circuit 3.

The timing generating circuit 5, which includes a phase-locked loop (PLL) circuit, receives a horizontal synchronization signal VSYNC, to thereby generate various timing signals for controlling the gate bus line driving circuits 2 and the data bus line driving circuit 3 in addition to the signal processing circuit 4. For example, the timing generating circuit 5 generates a start pulse signal ST for showing the first gate bus line of a displayed image in synchronization with the horizontal synchronization signal HSYNC, and a shift clock signal SCK for shifting the scan line of the displayed image in synchronization with the vertical synchronization signal VSYNC.

Figure 2:
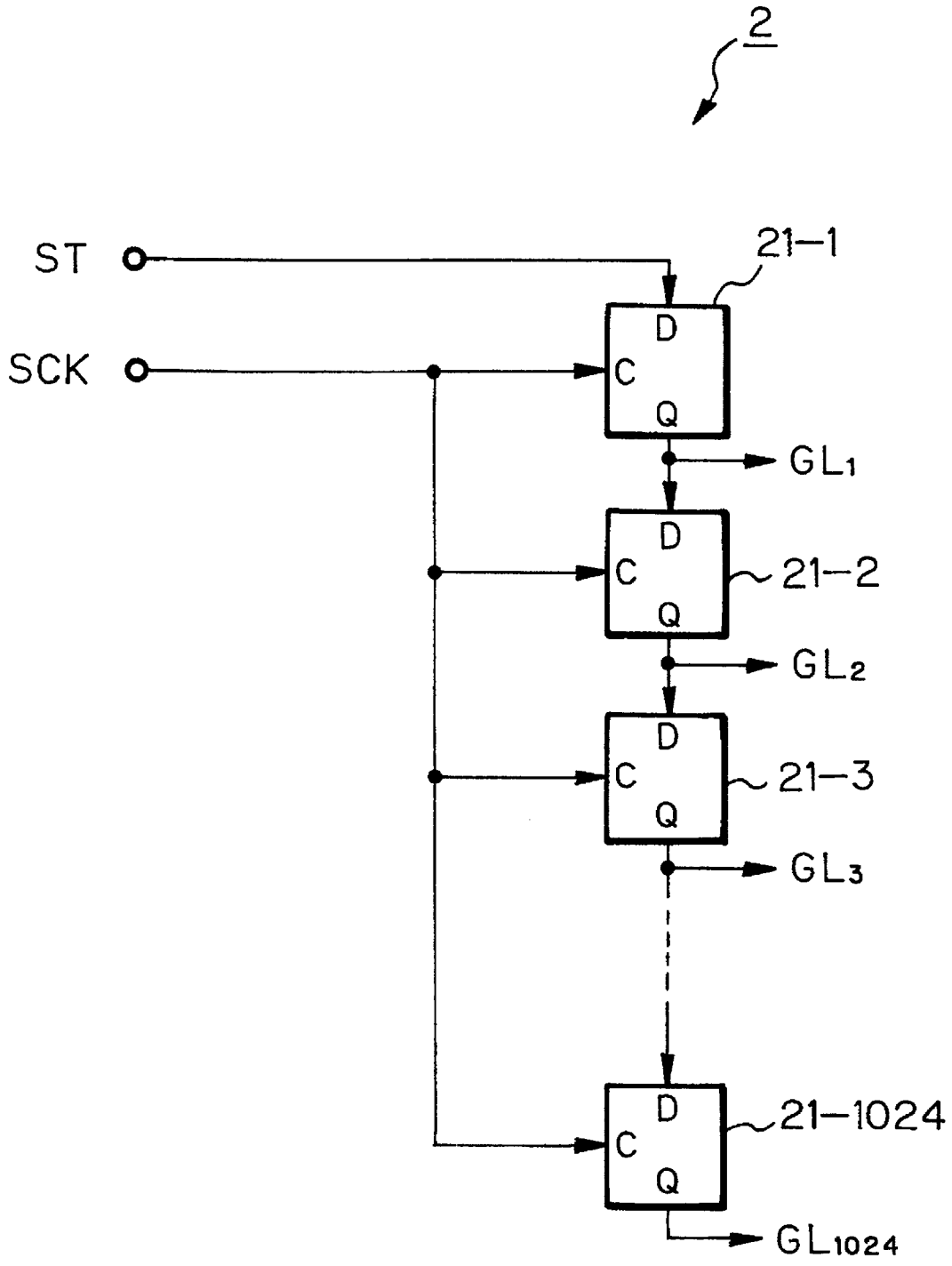
Fig. 2 PRIOR ART
FIG. 2 is a detailed block circuit diagram of the gate bus line driving circuit of FIG. 1.
Figures 3A, 3B, 3C, 3D, 3E:
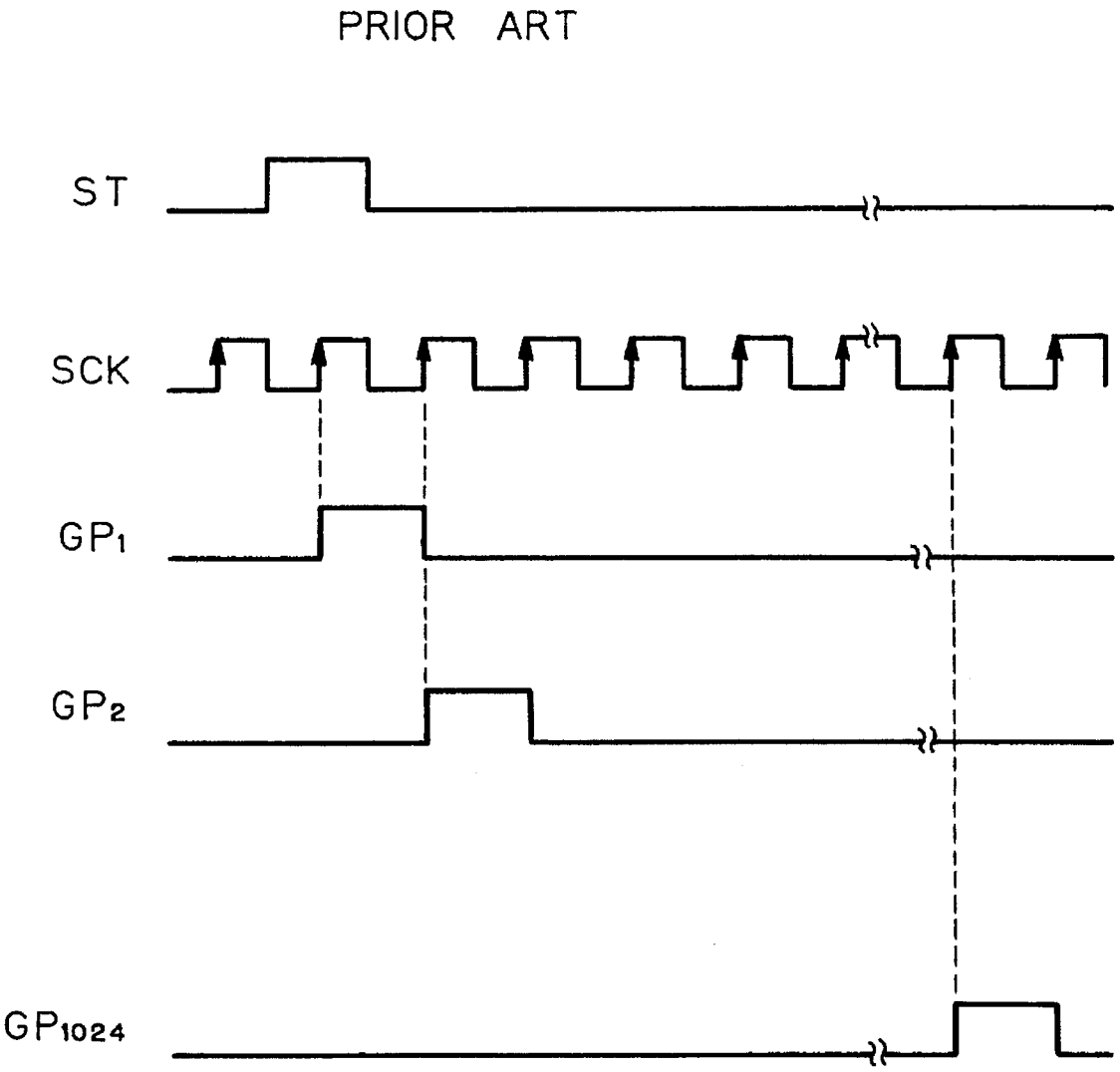
FIGS. 3A through 3E are timing diagrams showing the operation of the circuit of FIG. 2.

In FIG. 2, which is a detailed block circuit diagram of the gate bus line driving circuit 2 of FIG. 1, shift registers (D flip-flops) 21-1, 21-2, . . . , 21-1024 are serially-connected for driving the gate bus lines $GL_1$ , $GL_2$, $GL_{1024}$, respectively. In FIG. 2, the start pulse signal ST as shown in FIG. 3A is supplied to the first stage of the shift registers, i.e., the shift register 21-1, and the start pulse signal ST is shifted through the shift registers 21-1, 21-2, . . . , 21-1024 by the shift clock signal SCK as shown in FIG. 3B. As a result, the gate bus lines $GL_1$, $GL_2$, . . . , $GL_{1024}$ are sequentially driven by the output signals of the shift registers 21-1, 21-2, . . . , 21-1024, i.e., gate pulses $GP_1$, $GP_2$, . . . , $GP_{1024}$ in FIGS. 3C, 3D, and 3E.

Figure 4A:
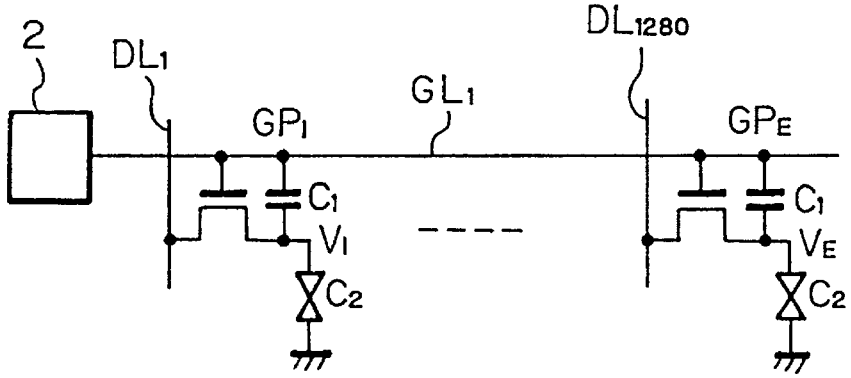
Fig. 4A PRIOR ART
FIG. 4 is a timing diagram explaining feedthrough voltages generated in the circuit of FIG. 1.
Figure 4B:
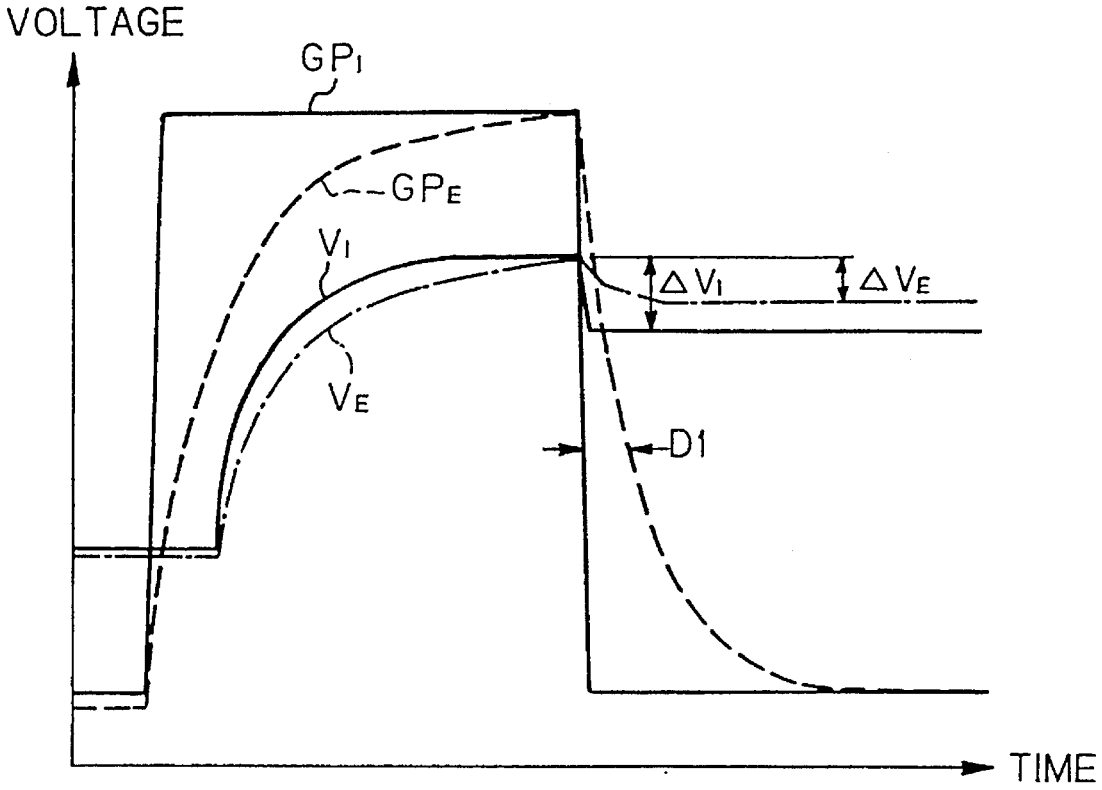
Fig. 4B PRIOR ART

As shown in FIG. 4, when the gate pulse is turned OFF, a shift called a feedthrough is generated in the pixel voltage (drain voltage of the TFT). However, a gate pulse applied to a gate bus line such as $GL_1$ is propagated with a delay due to the resistance thereof and the like. For example, in the first pixel located near the gate bus line driving circuit 2, the voltage $GP_I$ at the gate bus line $GL_1$ falls with no substantial delay, and therefore, the pixel voltage $V_I$, of the first pixel is reduced by a feedthrough voltage$\Delta V_I$which is dependent upon a ratio of a parasitic capacitance $C_1$ between the gate and drain of the TFT to a capacitance $C_2$ of the liquid crystal cell. Contrary to this, in the 1280-th pixel far away from the gate bus line dirving circuit 2, the voltage $GP_E$ at the gate bus line $GL_1$ falls with a large delay D1. Therefore, when the gate pulse $GP_1$ is turned OFF, the TFT of the 1280-th pixel is not turned OFF for a while. As a result, the voltage at the data bus line $DL_{1280}$ is leaked to the liquid crystal cell of the 1028-th pixel. Thus, the pixel voltage $V_E$ of the 1280-th pixel is reduced by a feedthrough voltage$\Delta V_E$ which is smaller than$\Delta V_I$.

Thus, even when data voltages of the data bus lines $DL_1$, $DL_2$, . . . , $DL_{1280}$ are all the same, a difference, which is the same as the difference $(\Delta V_I - \Delta V_E)$ in feedthrough voltage, is generated in the retention voltages of the pixels. This may reduce the duration of life of the LCD panel by the application of a DC voltage thereto.

In order to reduce the difference $(\Delta V_I - \Delta V_E)$ in feedthrough voltage, another gate bus line driving circuit 2', which has the same configuration as the gate bus line driving circuit 2, is provided on an opposite side thereof (see: JP-A-SHO57-100467). Therefore, a time constant between one pixel and one of the gate bus line driving circuits 2 and 2' close to the one pixel is substantially reduced by ¼ as compared with the apparatus as illustrated in FIG. 1. As a result, the difference in feedthrough voltage is reduced.

Figure 5:
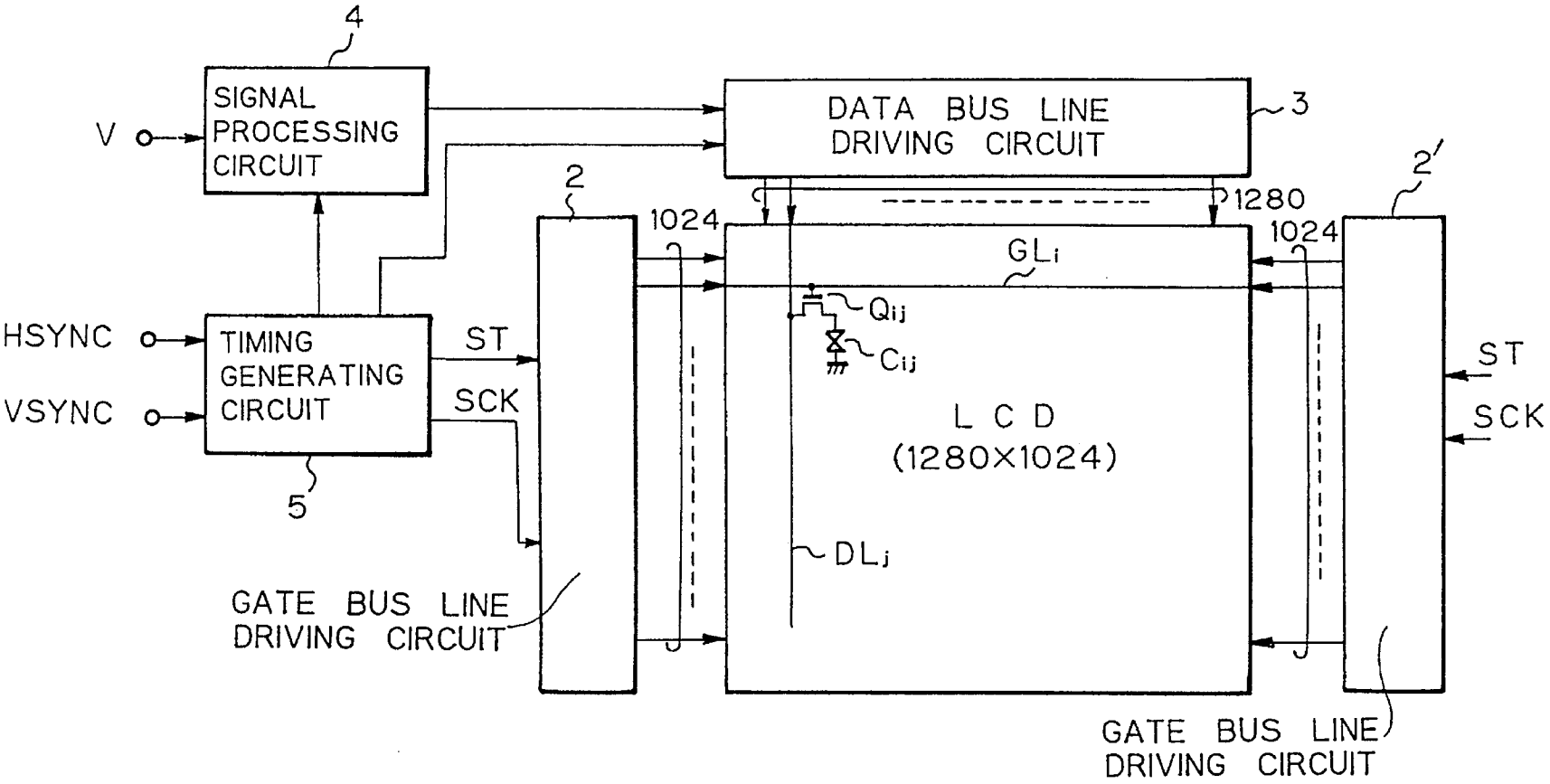
Fig. 5 PRIOR ART
FIG. 5 is a block circuit diagram illustrating another prior art apparatus for driving an LCD panel.

In the apparatus of FIG. 5, however, two gate bus line driving circuits are provided, thus increasing the hardware of the driving apparatus. This may increase the manufacturing costs thereof. Particularly, when an LCD panel uses amorphous silicon TFTs which have a small mobility, it is difficult to manufacture the apparatus of FIG. 5.

Figure 6:
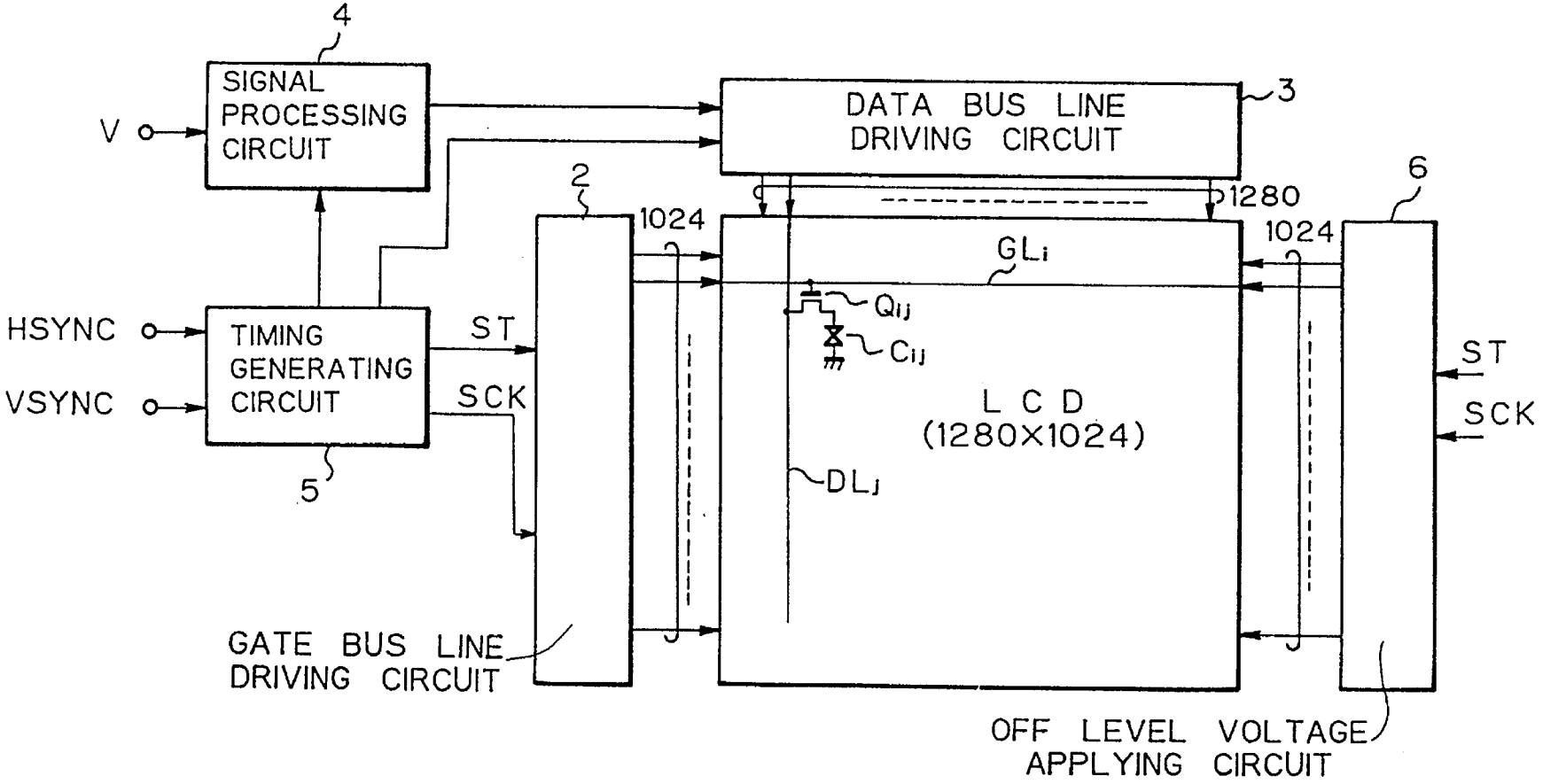
FIG. 6 is a block circuit diagram illustrating an embodiment of the apparatus for driving an LCD panel according to the present invention.

In FIG. 6, which illustrates an embodiment of the present invention, an OFF level voltage applying circuit 6 is provided instead of the gate bus line driving circuit 2' of FIG. 5. The OFF level voltage applying circuit 6 applies an OFF level voltage to a gate bus line selected by the gate bus line driving circuit 2 immediately after the gate bus line enters a non-selected state.

The OFF level voltage applying circuit 6 is explained next in detail with reference to FIG. 7.

Figure 7:
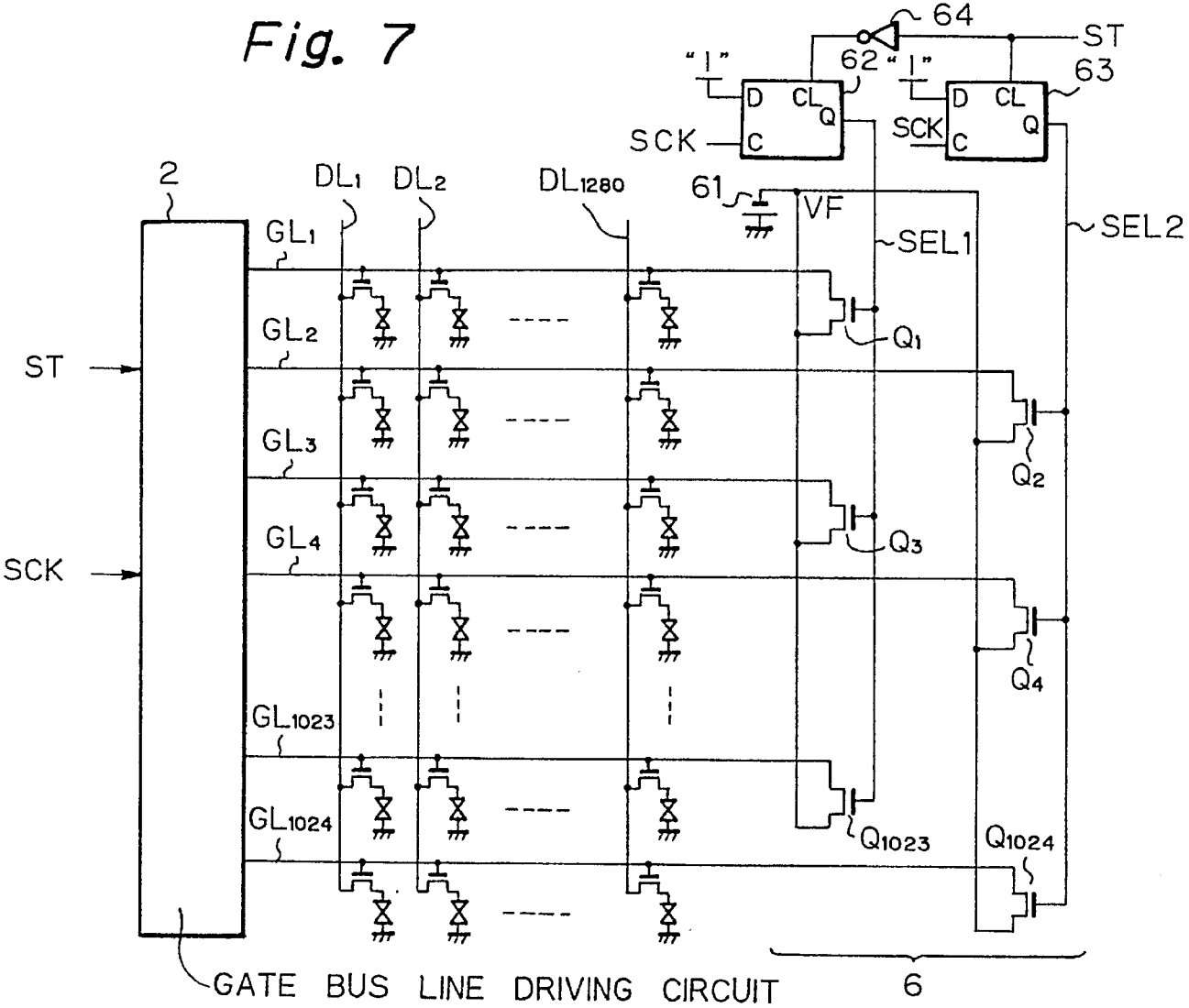
FIG. 7 is a detailed block circuit diagram of the OFF level voltage applying circuit of FIG. 5.

In FIG. 7, switching transistors (TFT's) $Q_1$, $Q_2$, . . . , $Q_{1024}$ are provided. Sources of the switching transistors $Q_1$, $Q_2$, . . . , $Q_{1024}$ are connected to the ends of the gate bus lines $GL_1$, $GL_2$, . . . , $GL_{1024}$, respectively. Also, drains of the switching transistors $Q_1$, $Q_2$, . . . , $Q_{1024}$ are connected to an OFF level voltage power supply unit 61 for generating an OFF level voltage VF. Note that the OFF level voltage VF is so low as to turn OFF all of the TFTs of the pixels in spite of their states. Further, gates of the switching transistors $Q_1$, $Q_3$, . . . , $Q_{1023}$ are connected to a D flip-flop 62 which generates a selection signal SEL1. Similarly, gates of the switching transistors $Q_2$, $Q_4$, . . . , $Q_{1024}$ are connected to a D flip-flop 63 which generates a selection signal SEL2.

The selection signal SEL1 is opposite in phase to the selection signal SEL2. That is, the selection signal SEL1 is reset by an inverted signal of the start pulse signal ST using an inverter 64, and is obtained by dividing the scan clock signal SCK. Similarly, the selection signal SEL2 is reset by the start pulse signal ST, and is obtained by dividing the scan clock signal SCK.

The operation of the circuit of FIG. 7 is explained with reference to FIGS. 8A through 8I.

Figures 8A, 8B, 8C, 8D, 8E, 8F, 8G, 8H, 8I:
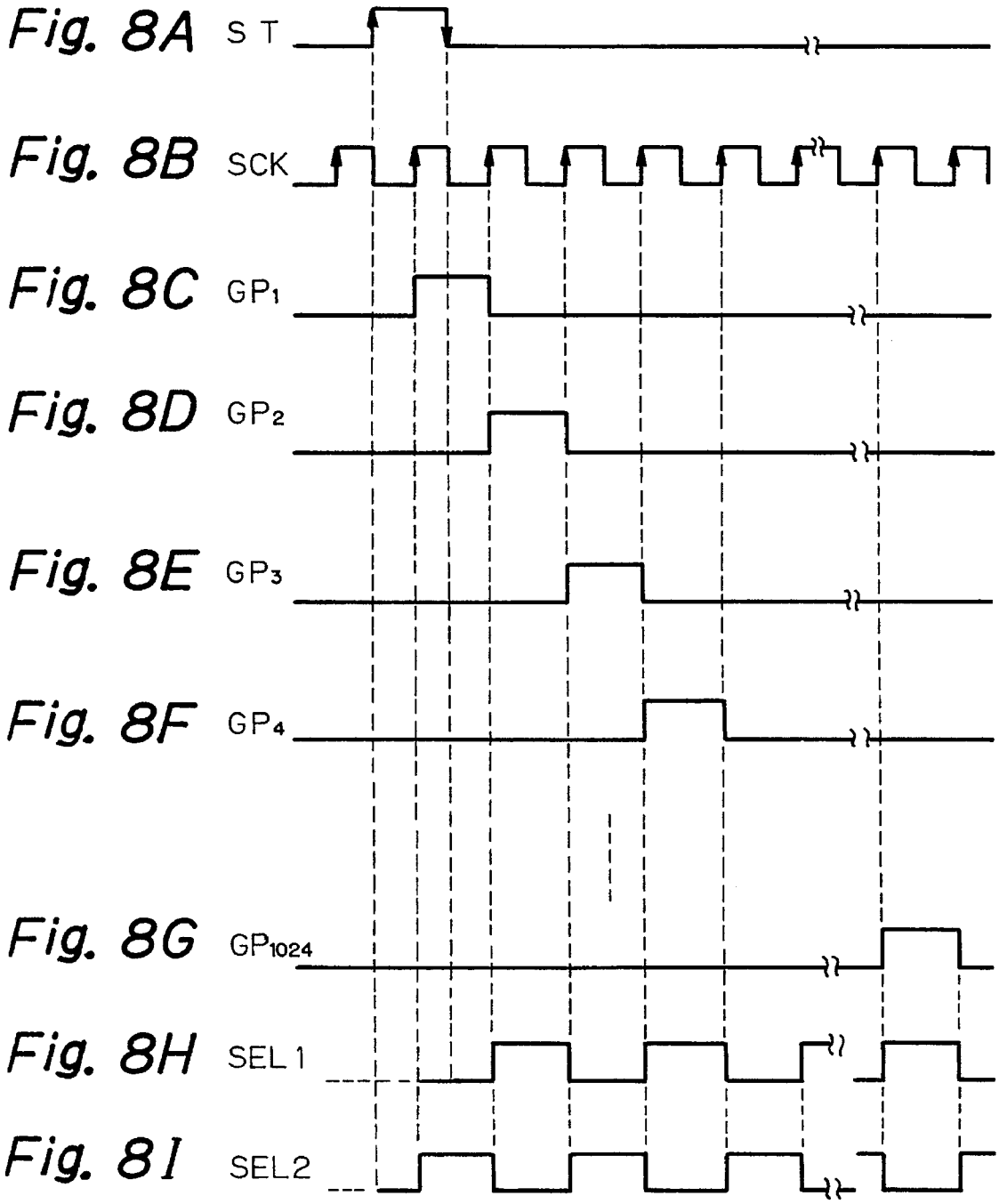
FIGS. 8A through 8I are timing diagrams showing the operation of the circuit of FIG. 7.

When the start pulse signal ST as shown in FIG. 8A and the scan clock signal SCK as shown in FIG. 8B are supplied to the gate bus line driving circuit 2, this circuit 2 generates gate pulses $GP_1$, $GP_2$, $GP_3$, $GP_4$, . . . , $GP_{1024}$ as shown in FIGS. 8C, 8D, 8E, 8F, 8G and 8H, and applies them to the gate bus lines $GL_1$, $GL_2$, $GL_3$, $GL_4$, . . . $GL_{1024}$, respectively.

Also, the flip-flop 62 is reset by a falling edge of the start pulse signal ST as shown in FIG. 8A, and divides the scan clock signal SCK as shown in FIG. 8B. Thus, the selection signal SEL1 is obtained as shown in FIG. 8H.

Similarly, the flip-flop 63 is reset by a rising edge of the start pulse signal ST as shown in FIG. 8A, and divides the scan clock signal SCK as shown in FIG. 8B. Thus, the selection signal SEL2 is obtained as shown in FIG. 8I.

Thus, when the selection signal SEL1 is high, the gate bus lines $GL_1$, $GL_3$, . . . , $GL_{1023}$ are connected to the OFF level voltage power supply unit 61, and, when the selection signal SEL1 is low, the gate bus lines $GL_1$, $GL_3$, . . . , $GL_{1023}$ are disconnected from the OFF level voltage power supply unit 61, i.e., are in a high impedance state.

Similarly, when the selection signal SEL2 is high, the gate bus lines $GL_2$, $GL_4$, . . . , $GL_{1024}$ are connected to the OFF level voltage power supply unit 61, and, when the selection signal SEL2 is low, the gate bus lines $GL_2$, $GL_4$, . . . , $GL_{1024}$ are disconnected from the OFF level voltage power supply unit 61, i.e., in a high impedance state.

Figure 9A:
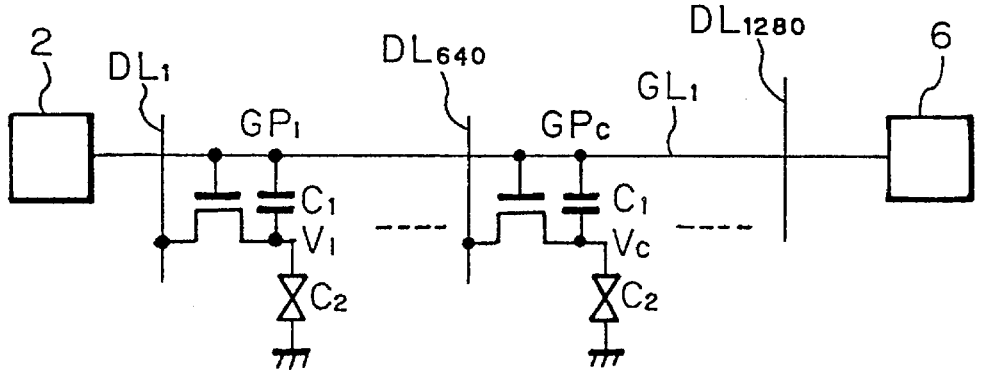
FIG. 9 is a timing diagram explaining feedthrough voltages generated in the circuit of FIG. 7.
Figure 9B:
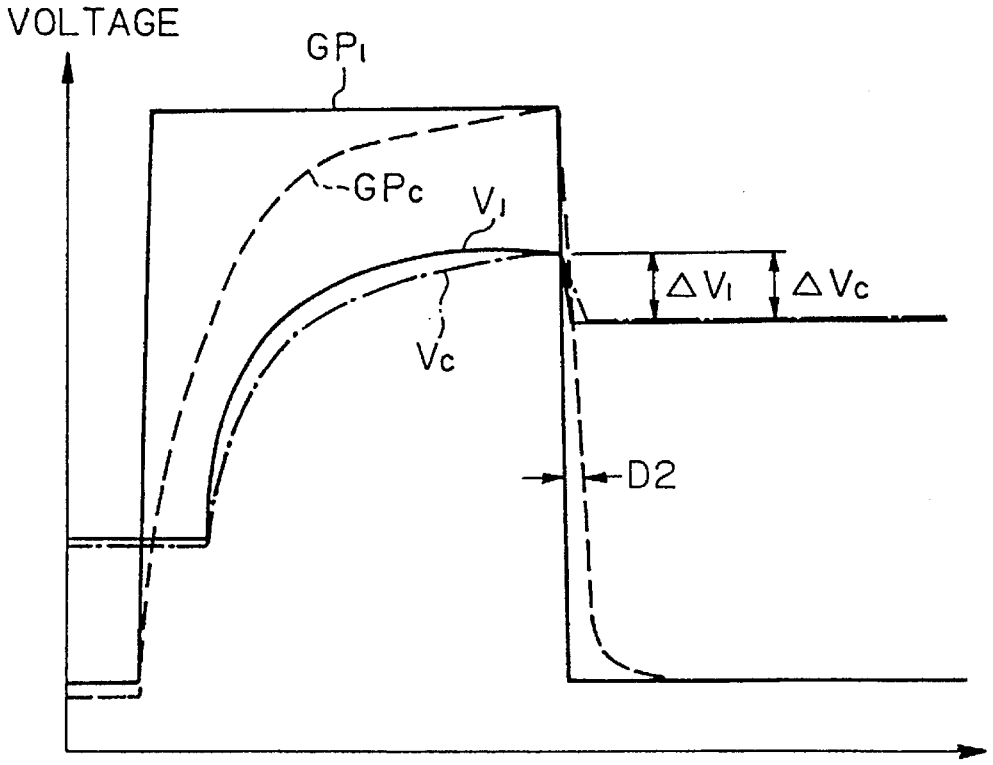

As shown in FIG. 9, in the first pixel located near the gate bus line driving circuit 2, the voltage $GP_I$ at the gate bus line $GL_1$ falls with no substantial delay, and therefore, the pixel voltage $V_I$ of the first pixel is reduced by the feedthrough voltage$\Delta V_I$ in the same way as in FIG. 4. Contrary to this, in the 640-th pixel at the center between the gate bus line driving circuit 2 and the OFF level voltage applying circuit 6, the voltage $GP_c$ at the gate bus line $GL_1$ falls with a relatively small delay D2. Note that, this delay D2 is reduced as comparaed with the delay D1 of the voltage $GP_E$ of FIG. 4. As a result, when the voltage at the data bus line $DL_{640}$ is leaked to the liquid crystal cell of the 640-th pixel, the pixel voltage $V_c$ of the 640-th pixel is reduced by a feedthrough voltage$\Delta V_c$ which is about the same as$\Delta V_I$.

Thus, even when data voltages of the data bus lines $DL_1$, $DL_2$, . . . , $DL_{1280}$ are all the same, only a small difference, which is the same as the difference $(\Delta V_I - \Delta V_c)$ in feedthrough voltage, is generated in the retention voltages of the pixels. Therefore, the brightness is more uniform as compared with the prior art. Also, since a spurious DC voltage applied to the liquid crystal cells is suppressed, the duration of the life of the LCD panel can be lengthened.

In the above-described embodiment, the switching transistors $Q_1, Q_2, \ldots, Q_{1024}$ are formed by TFT's which are located on the same glass substrate on which the TFT's of the pixels are formed. However, the switching transistors $Q_1, Q_2, \ldots, Q_{1024}$ can be provided externally to the glass substrate. Also, the switching transistors can use MOS transistors or bipolar transistors formed on a monocrystalline silicon substrate.

As explained hereinbefore, according to the present invention, the deviation of feedthrough voltage can be reduced without increasing the hardware. Therefore, the brightness can be uniform, and the duration of the life of LCD panels can be lengthened.

I claim:

1. An apparatus for driving a liquid crystal display panel having a plurality of gate bus lines, a plurality of data bus lines, and a plurality of pixels, each pixel including a liquid crystal cell and a first switching transistor connected between said liquid crystal cell and one of said data bus lines and having a gate connected to one of said gate bus lines, comprising:

a gate bus line driving circuit, connected to first ends of said gate bus lines, for selecting one of said gate bus lines and applying a gate pulse to the one of said gate bus lines; and an OFF level voltage applying circuit, connected to second ends of said gate bus lines opposite to the first ends thereof, for applying an OFF level voltage to the selected one of said gate bus lines from the second end thereof immediately after said gate pulse is turned OFF.

2. An apparatus as set forth in claim 1, wherein said OFF level voltage applying circuit comprises:

an OFF level voltage generator;

a plurality of second switching transistors, each connected between said OFF level voltage generator and the second end of one of said gate bus lines; and controlling means, conndected to said second switching transistors, for turning ON a respective one of said second switching transistors immediately after said gate pulse is turned OFF.

3. An apparatus as set forth in claim 2, wherein said controlling means comprises a first selection signal generating circuit for generating a first selection signal and transmitting said first selection signal to an i-th (i=1, 3, 5, . . .) one of said second switching transistors, and a second selection signal generating circuit for generating a second selection signal opposite in phase to said first selection signal and transmitting said second selection signal to an (i+1)-th (i=1, 3, 5, . . .) one of said second switching transistors.

4. An apparatus as set forth in claim 1, further comprising:

a start pulse generating means for generating a start pulse in synchronization with a horizontal synchronization signal; and a scan clock signal generating means for generating a scan clock signal, said gate bus line driving circuit comprising a plurality of serially-connected shift registers, connected to said start pluse generating means and said scan clock signal generating means, for receiving and shifting said start pulse signal in response to said scan clock signal, to transmit a shifted signal of said start pulse signal to a respective one of said gate bus lines as said gate pulse.

5. An apparatus as set forth in claim 4, wherein said OFF level voltage applying circuit comprises:

an OFF level voltage generator;

a plurality of second switching transistors, each connected between said OFF level voltage generator and the second end of one of said gate bus lines;

a first selection signal generating circuit, connected to said start pulse generating means and said scan clock signal generating means, for generating a first selection signal which is reset by one of said start pulse and an inverted signal of said start pulse and is obtained by dividing said scan clock signal, said first selection signal being supplied to an i-th (i=1, 3, 5, . . .) one of said second switching transistors; and a second selection signal generating circuit, connected to said start pulse generating means and said scan clock signal generating means, for generating a second selection signal which is reset by the other of said start pulse and an inverted signal of said start pulse and is obtained by dividing said scan clock signal, said second selection signal being supplied to an (i+1)-th (i=1, 3, 5, . . .) one of said second switching transistors.

6. An apparatus as set forth in claim 1, wherein each of said first switching transistors comprises a TFT transistor.

7. An apparatus as set forth in claim 2, wherein each of said second switching transistors comprises a TFT transistor.

8. An apparatus as set forth in claim 5, wherein each of said second switching transistors comprises a TFT transistor.

9. An apparatus for driving a liquid crystal display panel having a plurality of gate bus lines, a plurality of gate bus lines, and a plurality of pixels, each pixel including a liquid crystal cell and a first switching transistor connected between said liquid crystal cell and one of said data bus lines and having a gate connected to one of said gate bus lines, comprising:

a start pulse generating means for generating a start pulse in synchronization with a horizontal synchronization signal; and a scan clock signal generating means for generating a scan clock signal;

a gate bus line driving circuit including a plurality of serially-connected shift registers, connected to said start pluse generating means and said scan clock signal generating means, for receiving and shifting said start pulse signal in response to said scan clock signal, to transmit a shifted signal of said start pulse signal to a respective one of said gate bus lines as a gate pulse;

an OFF level voltage generator;

a plurality of second switching transistors, each connected between said OFF level voltage generator and a second end of one of said gate bus lines, said second end being opposite to a respective one of said first ends;

a first selection signal generating circuit, connected to said start pulse generating means and said scan clock signal generating means, for generating a first selection signal which is reset by one of said start pulse and an inverted signal of said start pulse and is obtained by dividing said scan clock signal, said first selection signal being supplied to an i-th (i=1, 3, 5, . . .) one of said second switching transistors; and a second selection signal generating circuit, connected to said start pulse generating means and said scan clock signal generating means, for generating a second selection signal which is reset by the other of said start pulse and an inverted signal of said start pulse and is obtained by dividing said scan clock signal, said second selection signal being supplied to an (i+1)-th (i=1, 3, 5, . . .) one of said second switching transistors.

* * * * *